US009863732B2

(12) United States Patent
Curliss et al.

(10) Patent No.: US 9,863,732 B2
(45) Date of Patent: Jan. 9, 2018

(54) LIGHTWEIGHT COMPOSITE MORTAR TUBE

(71) Applicant: Proof Research, Inc., Columbia Falls, MT (US)

(72) Inventors: David Brian Curliss, Beavercreek, OH (US); Jason Edward Lincoln, Miamisburg, OH (US)

( * ) Notice: Subject to any disclaimer, the term of this patent is extended or adjusted under 35 U.S.C. 154(b) by 0 days.

(21) Appl. No.: 15/067,481

(22) Filed: Mar. 11, 2016

(65) Prior Publication Data

US 2016/0265863 A1 Sep. 15, 2016

Related U.S. Application Data

(63) Continuation-in-part of application No. PCT/US2014/069403, filed on Dec. 9, 2014, and a (Continued)

(51) Int. Cl.
*F41A 21/02* (2006.01)
*F41F 1/06* (2006.01)

(52) U.S. Cl.
CPC ..... *F41A 21/02* (2013.01); *F41F 1/06* (2013.01)

(58) Field of Classification Search
CPC . F41F 1/06; F41A 21/02–21/04; F41A 21/204
See application file for complete search history.

(56) References Cited

U.S. PATENT DOCUMENTS 2,845,741 A 8/1958 Day
2,847,786 A * 8/1958 Day ..... F41A 21/02 138/DIG. 2

(Continued)

FOREIGN PATENT DOCUMENTS

JP 2005155935 A * 6/2005 ..... F41A 21/02
WO 2007064442 A2 6/2007

(Continued)

OTHER PUBLICATIONS

Emerson et al., Approaches for the DEsign of Ceramic Gun Barrels, Nov. 1, 2006, U.S. Army Research Laboratory.*

(Continued)

*Primary Examiner* — Stephen Johnson
*Assistant Examiner* — Joshua T Semick
(74) *Attorney, Agent, or Firm* — Antoinette M. Tease

(57) ABSTRACT

A composite barrel assembly for a gun, such as a muzzle-loading mortar for fin-stabilized projectiles. The composite construction of the barrel has a plurality of generally concentric layers built-up around a rigid supporting liner which may be fabricated from any of several metal or ceramic compositions. An inner thermal barrier coating of inorganic glass, metal refractory alloy, chromium alloy, functionally graded material or ceramic is disposed within the liner. An overwrap layer of continuous fibers embedded in a matrix surrounds the liner. The matrix is either a resin, polymer, ceramic, glass or metal. An outer shell of continuous fibers embedded in a high temperature polymer matrix surrounds the overwrap. When the liner is made from a metal-based composition, an outer thermal barrier coating may be applied in between the liner and the overwrap.

8 Claims, 8 Drawing Sheets

Related U.S. Application Data continuation-in-part of application No. 14/914,694, filed as application No. PCT/US2014/053194 on Aug. 28, 2014.

(60) Provisional application No. 62/131,561, filed on Mar. 11, 2015, provisional application No. 61/913,825, filed on Dec. 9, 2013, provisional application No. 61/873,771, filed on Sep. 4, 2013, provisional application No. 61/871,154, filed on Aug. 28, 2013.

(56) References Cited

U.S. PATENT DOCUMENTS

| | | | | |
|---|---|---|---|---|
| 3,517,585 | A * | 6/1970 | Slade | F41A 21/02 42/76.01 |
| 3,879,244 | A | 4/1975 | Varlas | |
| 4,360,626 | A | 11/1982 | Manwiller | |
| 4,641,450 | A | 2/1987 | Moll et al. | |
| 4,669,212 | A * | 6/1987 | Jackson | B32B 15/01 42/76.02 |
| 4,685,236 | A * | 8/1987 | May | F41A 21/02 42/76.02 |
| 4,755,555 | A | 7/1988 | Manwiller et al. | |
| 4,841,836 | A | 6/1989 | Bundy | |
| 5,013,817 | A | 5/1991 | Ohta et al. | |
| 5,043,419 | A | 8/1991 | Ohta et al. | |
| 5,054,224 | A * | 10/1991 | Friar | F41A 21/02 42/76.02 |
| 5,125,179 | A * | 6/1992 | Campbell | B29C 70/56 42/76.02 |
| 5,191,165 | A | 3/1993 | Oskarsson et al. | |
| 5,341,719 | A * | 8/1994 | Bullis | F41A 21/02 89/14.05 |
| 5,348,598 | A | 9/1994 | Vives et al. | |
| 5,531,150 | A * | 7/1996 | Gegaregian | F41F 1/06 89/15 |
| 5,600,912 | A | 2/1997 | Smith | |
| 5,657,568 | A * | 8/1997 | Christensen | F41A 21/02 42/76.01 |
| 5,692,334 | A * | 12/1997 | Christensen | F41A 21/02 42/76.02 |
| 5,804,756 | A * | 9/1998 | Christensen | F41A 21/02 42/76.02 |
| 5,817,418 | A | 10/1998 | Goto et al. | |
| 5,886,129 | A | 3/1999 | DeColibus | |
| 6,189,431 | B1 | 2/2001 | Danner et al. | |
| 6,889,464 | B2 * | 5/2005 | Degerness | F41A 21/02 42/76.01 |
| 7,650,710 | B1 | 1/2010 | Conroy et al. | |
| 7,721,478 | B2 * | 5/2010 | Withers | F41A 21/04 42/76.02 |
| 7,758,781 | B2 | 7/2010 | Schmeckpeper et al. | |
| 7,798,046 | B2 * | 9/2010 | Burkholder | F41A 21/34 89/14.3 |
| 7,802,963 | B2 | 9/2010 | Holland et al. | |
| 7,921,590 | B2 | 4/2011 | Briggs | |
| 7,934,332 | B2 | 5/2011 | Briggs | |
| 7,934,652 | B2 * | 5/2011 | Hasselbring | F41G 3/02 235/404 |
| 7,963,202 | B1 | 6/2011 | Becker et al. | |
| 8,020,333 | B2 * | 9/2011 | Hall | F41A 21/02 42/76.01 |
| 8,198,356 | B2 | 6/2012 | Dauer et al. | |
| 8,316,568 | B2 | 11/2012 | Briggs | |
| 8,595,971 | B2 | 12/2013 | Johnson | |
| 8,677,670 | B2 * | 3/2014 | Christensen | F41A 21/02 42/78 |
| 2003/0078170 | A1 | 4/2003 | Brown | |
| 2003/0228466 | A1 | 12/2003 | Wei et al. | |
| 2004/0244257 | A1 | 12/2004 | Degerness | |
| 2005/0175805 | A1 | 8/2005 | Hild et al. | |
| 2005/0268517 | A1 | 12/2005 | Withers et al. | |
| 2006/0135655 | A1 | 6/2006 | Miller | |
| 2007/0256345 | A1 | 11/2007 | Hall et al. | |
| 2007/0261599 | A1 | 11/2007 | Schwab et al. | |
| 2009/0068441 | A1 | 3/2009 | Swaroop et al. | |
| 2009/0217812 | A1 | 9/2009 | Whitaker et al. | |
| 2010/0304119 | A1 | 12/2010 | Bonneau et al. | |
| 2010/0310823 | A1 | 12/2010 | Albertelli et al. | |
| 2011/0162246 | A1 | 7/2011 | Briggs | |
| 2012/0052287 | A1 | 3/2012 | Bonneau et al. | |

FOREIGN PATENT DOCUMENTS

| | | |
|---|---|---|
| WO | 2015031635 A1 | 3/2015 |
| WO | 2015130379 A2 | 9/2015 |

OTHER PUBLICATIONS

Heim et al., ONR's Advanced Gun Barrel Technologies Program, Department of the Navy Science & Technology.*

Machine Translation of JP 2005-155935 to Ishizuka, European Patent Office, Jun. 2005.*

Littlefield et al., Prestressed Carbon Fiber Composite Overwrapped Gun Tube, J. Pressure Vessel Technol. 134(4), 041008 (Jul. 27, 2012).

Prestressed Carbon Fiber Composite Overwrapped Gun Tubepeek Resin.

"Continuous Fiber Reinforcements" (Automated Dynamics) Jun. 10, 2014 (Jun. 10, 2014) [online].[retrieved from the Internet on Jun. 24, 2016], https://web.archive.org/web/20140610071918/http:i/www.automateddynamics.c,om/article/ thermoplastic-composite-basics/types-of-thermoplastic-composites/continuous-fiber-reinforcements, entire document.

"U.S. Marines Firing M252 81mm Mortar System" (AiirSource Military) Jan. 18, 2014 (Jan. 18, 2014) [Youtube.com], https://www.youtube.com/watch?v=3Tk3-cQ40tw, entiredocument.

Wu, Qi-Jun, Partial English translation of "Researches on the theory and application of composite barrel," Nanjing University of Science and Technology, Aug. 2011, 14pgs.

Wu, Qi-Jun, Researches on the theory and application of composite barrel, Nanjing University of Science and Technology, Aug. 2011, China Academic Journal Electronic Publishing House, http://www.cnki.net, pp. 1-7.

* cited by examiner

LIGHTWEIGHT COMPOSITE MORTAR TUBE

CROSS REFERENCE TO RELATED APPLICATIONS

This application claims priority to Provisional Patent Application No. 62/131,561 filed Mar. 11, 2015. In addition, this application is a Continuation in Part of International Patent Application No. PCT/US14/69403 filed Dec. 9, 2014, which claims priority to US Provisional Patent Application No. 61/913,825 filed Dec. 9, 2013, and this application is also a Continuation in Part of U.S. patent application Ser. No. 14/914,694 filed Feb. 26, 2016, which claims priority to International Patent Application No. PCT/US14/53194, which claims priority to US Provisional Patent Application No. 61/871,154 filed Aug. 28, 2013 and U.S. Provisional Patent Application No. 61/873,771 filed Sep. 4, 2013, the entire disclosures of which are hereby incorporated by reference and relied upon.

BACKGROUND OF THE INVENTION

Field of the Invention

The invention relates generally to a composite gun barrel, and more particularly to an improved barrel used in a light mortar for fin-stabilized projectiles.

Description of Related Art

A typical 81-mm mortar system, such as an M252 model, weights approximately 93.5 pounds without ammunition. The barrel 12 portion of the M252 mortar alone weighs approximately 35 pounds. This weight represents a significant carry burden to ground troops, especially when traversing rough and hilly terrain or over long distances. In contrast, the smaller 60-mm mortar system, such as the M224 model, weights approximately 46.5 pounds without ammunition. The barrel 12 portion of the M224 mortar weighs approximately 18 pounds. Naturally, a 60-mm is a significantly easier carry burden for ground troops, at the expense of significantly reduced firepower.

Published specifications for the M252 model (81-mm) mortar system indicate that the system must be capable of sustaining indefinite firings at a rate of 15 rounds per minute (i.e., one round fired every 4 seconds). Furthermore, the M252 model mortar system must be capable of firing 30 rounds per minute for two minutes without over-heating or malfunctioning. As a consequence of these stringent requirements, a muzzle-loading mortar assembly for launching fin-stabilized projectiles must be designed and constructed to withstand unusually high temperatures and harsh abrasions.

There is a need for a muzzle-loading mortar assembly for launching a fin-stabilized projectile that is light and easily transported by ground troops, that can withstand continuous firings without overheating or evidence of harmful erosion, but that does not sacrifice firepower.

BRIEF SUMMARY OF THE INVENTION

According to a first aspect of this invention, a muzzle-loading mortar assembly for launching a fin-stabilized projectile is provided. The assembly includes a barrel. The barrel has a generally tubular construction centered around a longitudinal axis. The barrel has a breech end and an opposite muzzle end. In order to achieve the objectives of this invention, which include enabling a muzzle-loading mortar assembly that is light weight, durable, easily transported by ground troops and that can withstand continuous firings without overheating or evidence of harmful erosion without sacrificing firepower, the barrel is made of a composite construction composed of a plurality of generally concentric layers. The plurality of generally concentric layers includes a rigid supporting liner that is fabricated from a composition selected from the group consisting essentially of a metal alloy and a metal refractory and a ceramic and a metal matrix composite and a ceramic matrix composite. The liner has an inner cylindrical surface and an outer surface. The plurality of generally concentric layers also includes an overwrap surrounding the outer surface of the liner. The overwrap layer is comprised of continuous fibers embedded in a matrix. The matrix fabricated from a composition selected from the group consisting essentially of a resin and a polymer and a ceramic and a glass and a metal. Both the liner and the overwrap have respective average axial coefficients of thermal expansion. The compositions and constructions of the liner and the overwrap layer are such that the respective average axial coefficients of thermal expansion are generally equal to one another.

According to another aspect of this invention, a composite barrel assembly for a gun is provided, the gun being of the type that launches projectiles driven by the action of an explosive force. The composite barrel assembly is of generally tubular construction centered around a longitudinal axis. The barrel has a breech end and an opposite muzzle end. The composite construction of the barrel is composed of a plurality of generally concentric layers. The plurality of generally concentric layers includes a rigid supporting liner. The liner is fabricated from a composition selected from the group consisting essentially of a metal alloy and a metal refractory and a ceramic and a metal matrix composite and a ceramic matrix composite. The liner has an inner cylindrical surface and an outer surface. The plurality of generally concentric layers includes an overwrap surrounding the outer surface of the liner. The overwrap comprises continuous fibers embedded in a matrix. The matrix is fabricated from a composition selected from the group consisting essentially of a resin and a polymer and a ceramic and a glass and a metal. The plurality of generally concentric layers includes an inner thermal barrier disposed within the inner cylindrical surface of the liner. The inner thermal barrier is fabricated from a composition selected from the group consisting essentially of an inorganic glass and a metal refractory alloy and a chromium alloy and a functionally graded material and a ceramic. The plurality of generally concentric layers includes an outer shell surrounding the overwrap. The outer shell is comprised of continuous fibers embedded in a high temperature polymer matrix.

The objects of this present invention, which include but are not limited to the provision of a gun barrel for launching projectiles that is light and easily transported by ground troops, that can withstand continuous firings without overheating or evidence of harmful erosion, and that does not sacrifice firepower, are accomplished by the novel composite barrel assembly which has a composite construction composed of a plurality of generally concentric layers. The composite barrel, which is constructed of a plurality of specific layers, enables gun barrels for a wide range of applications, including but not limited to lightweight mortar projectile assemblies, that optimizes structural and thermal performance with exceptionally low mass.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1:
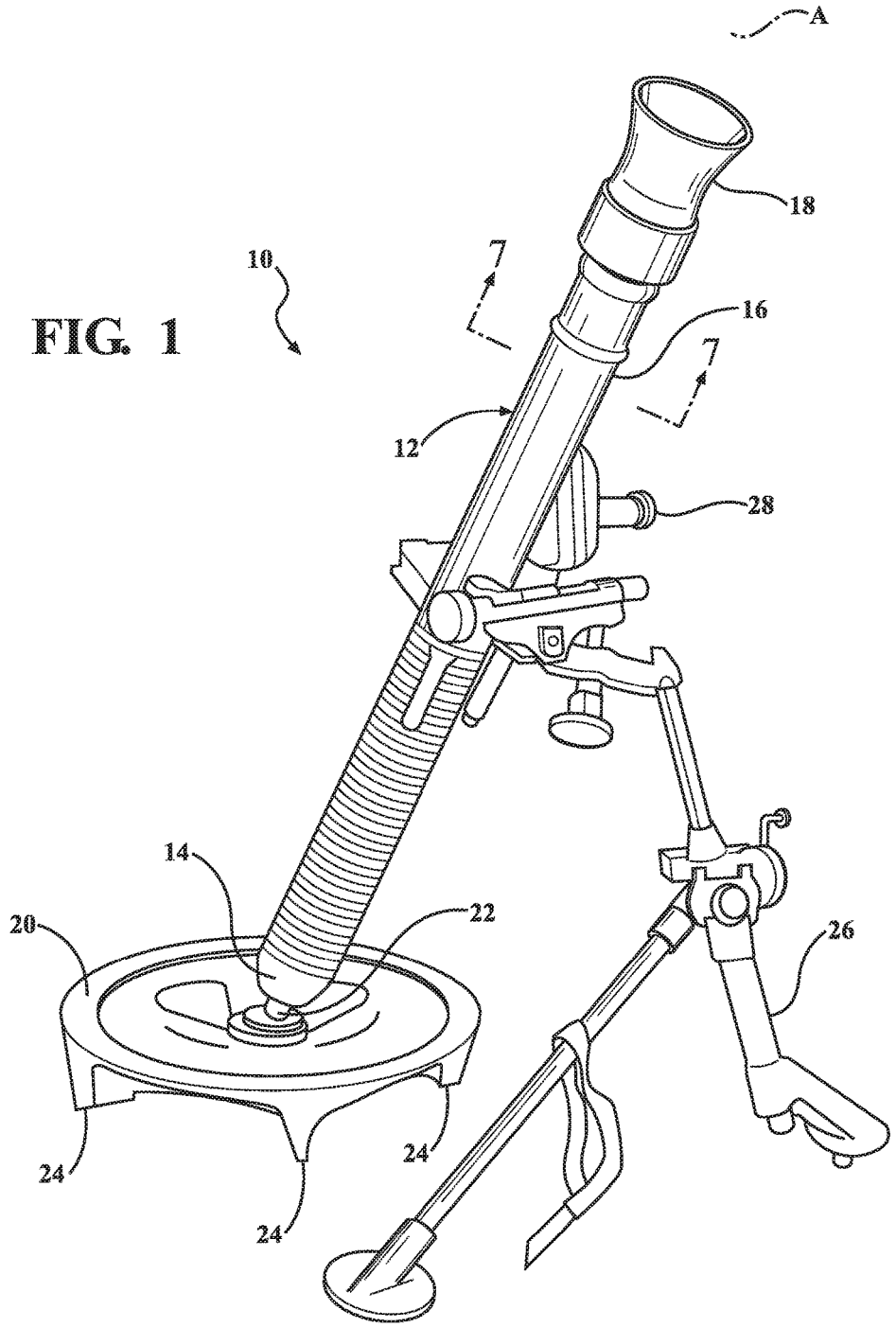
FIG. 1 is an illustrative view of a muzzle-loading mortar assembly according to one embodiment of the present invention.

Referring to the figures, wherein like numerals indicate like or corresponding parts throughout the several views, a muzzle-loading mortar assembly is generally shown at 10 in FIG. 1. The mortar assembly 10 is a type of gun designed to launch a fin-stabilized projectile (not shown) in a high looping trajectory toward a downrange target. The mortar assembly 10 could be of the afore-mentioned 81-mm (M252) type or the 60-mm (M224) type, or any other type of hand-held or ground-stabilize mortar-launching device. Furthermore, it will be appreciated that the principles of this invention are adaptable to other types of guns, including small bore hand-held firearms as well as the large bore types, and also recoilless munitions launchers (e.g., bazookas). In this sense, the specific depictions of and reference to a mortar assembly 10 will be understood as representing an exemplary, and perhaps preferred, context for the novel concepts of this invention.

Referring still to FIG. 1, the assembly 10 is provided with a barrel, generally indicated at 12. The barrel 12 may be characterized as a generally tubular construct centered around a longitudinal axis A. The barrel 12 has a breech end 14 and an opposite muzzle end 16. In the case of a typical mortar application, the breech end 14 is closed. However, in some contemplated application, e.g., recoilless systems, the breech 14 may be open. A blast attenuator 18 may, optionally, be affixed to the muzzle end 16. In some mortar assemblies 10, a baseplate 20 is connected to the barrel 12 via a coupling 22 that enables articulating movement therebetween. As shown in FIG. 1, the baseplate 20 may be fitted with a plurality of cleats 24 to help maintain a set position. A mounting arm 26 may be connected to the barrel 12 to establish three-point stabilization with respect to the baseplate 20. The mounting arm 26 typically includes one or more precise adjustment devices that allow the angle and position of the barrel 12 to be calibrated during the aiming process. To further this purpose, a sighting unit 28 may be affixed relative to the barrel 12 for optically surveying a downrange target. Of course, other gun-type applications of the barrel 12 would be expected include additional features and/or exclude some or all of the ancillary features mentioned above.

FIGS. 2-8 provided detailed illustrations of the design and fabrication of the barrel 12. The objects of this present invention, which include the provision of a muzzle-loading mortar assembly 10 for launching a fin-stabilized projectile that is light and easily transported by ground troops, that can withstand continuous firings without overheating or evidence of harmful erosion, but that does not sacrifice firepower, are accomplished by the novel barrel 12 which has a composite construction composed of a plurality of generally concentric layers. That is to say, the composite barrel 12, which is constructed of a plurality of specific layers, enables a lightweight mortar projectile assembly 10 that optimizes structural and thermal performance with exceptionally low mass.

The core, or back-bone, of the multi-layered barrel 12 is a rigid supporting liner 30 which defines or establishes the bore of the mortar projectile tube. The liner 30 may be seen in FIGS. 6 and 7 in the form of a thin-walled tube having an inner cylindrical surface and an outer surface. The outer surface may be cylindrical, or perhaps octagonal or stepped or tapered or some other geometric shape. The liner 30 may be fabricated from a composition selected from the group consisting essentially of a metal alloy and a metal refractory and a ceramic and a metal matrix composite and a ceramic matrix composite. That is to say, the liner 30 may be constructed of a metal alloy, a metal refractory, ceramic, a metal matrix composite, or a ceramic matrix composite. Regardless of the specific composition, the liner 30 will have an average coefficient of thermal expansion, the significance of which will be described in greater detail below.

Figure 6:
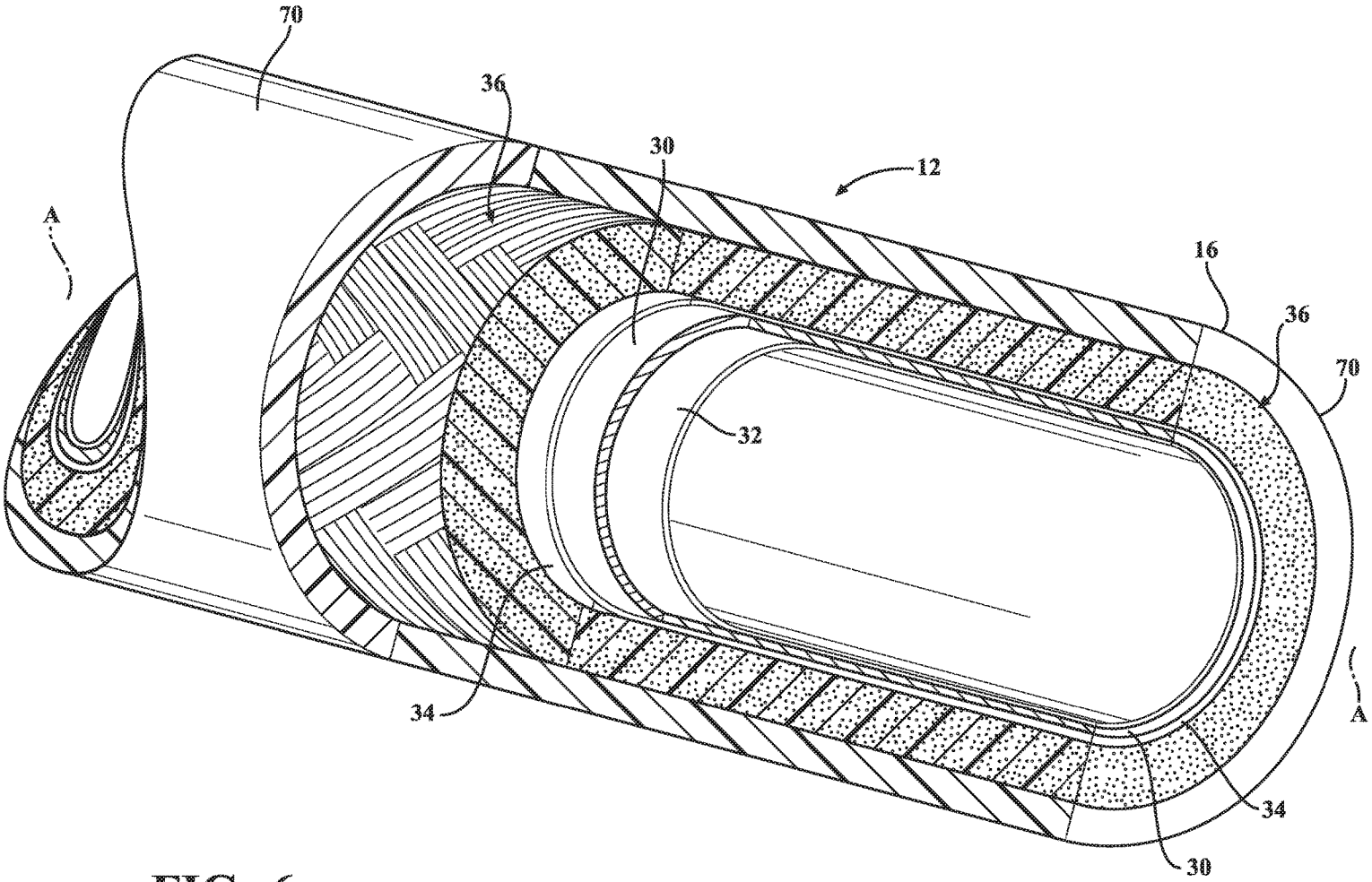
FIG. 6 is a partially sectioned fragment of the muzzle end of a barrel according to one embodiment of this invention, in which the varies composite layers are revealed.
Figure 7:
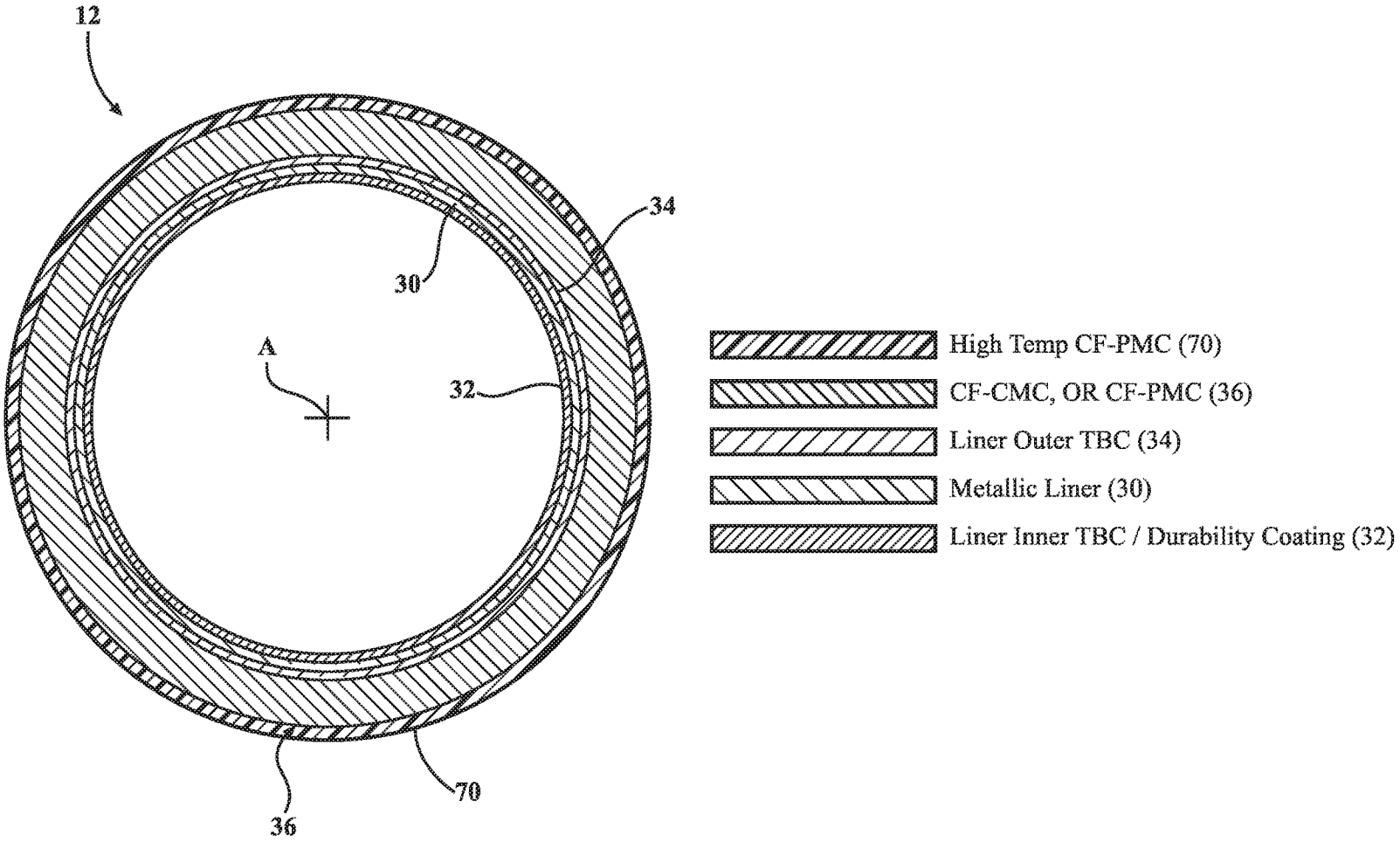
FIG. 7 is a cross-sectional view of the barrel as taken generally along lines 7-7 in FIG. 1.

In the embodiment of FIGS. 6-7, the liner 30 is shown in the form of a metallic alloy or a metal matrix composite. Potentially usable alloys include steel alloys; nickel-based alloys; aluminum alloys; titanium alloys; chromium alloys; niobium alloys; molybdenum alloys; tantalum alloys; cobalt alloys, austenite nickel-chromium-based alloys (such as Inconel®) and combinations of the foregoing, and further including the alloys and fabrication techniques disclosed in U.S. 2006/0288854 and U.S. Pat. No. 4,669,212, which are hereby incorporated in their entirety in all jurisdictions which permit such incorporation by reference. Other options include steel alloys, such as AISI type 416 stainless steel and other alloys in AISI classes 400 and 4000. The metal matrix composite could comprise a metal alloy itself reinforced with particulates, discontinuous fibers, or continuous fibers. The particulate and/or continuous fibers could be carbon, boron, metallic or ceramic. The liner 30 may also comprise a refractory metal.

Figure 8:
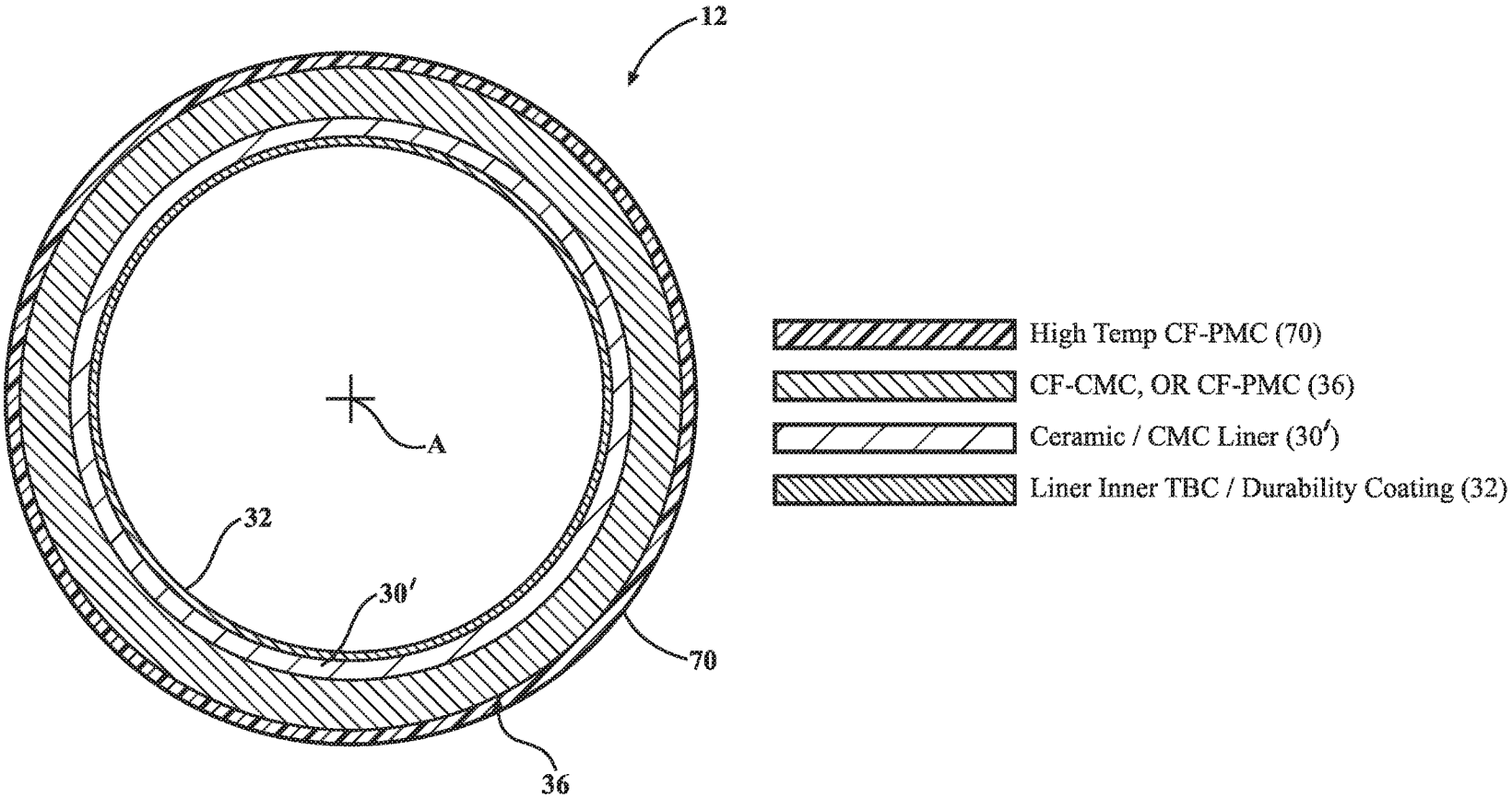
FIG. 8 is a cross-sectional view as in FIG. 7 but showing an alternative embodiment wherein the liner is fabricated from a ceramic material composition and the outer thermal barrier coating is beneficially omitted.

In another embodiment, the liner 30' may comprise ceramic material as shown for example in FIG. 8. Potentially usable ceramics include alumina, mullite, yttria stabilized zirconia, SiAlON, silicon carbide, and silicon nitride. The liner 30' may itself be a ceramic matrix composite tube, for example, a composite comprising continuous or discontinuous carbon fiber, aluminum oxide fiber, or silicon carbide fiber, reinforced with a matrix material such as glass, glass-ceramic, silicon carbide, silicon nitride, or SiAlON. The fiber in such thin-wall liners 30' may be set in a matrix using techniques known to those skilled in the art, including chemical vapor infiltration, polymer infiltration and pyrolysis, and reactive melt infiltration., etc. The structure and methods disclosed in U.S. Pat. No. 4,435,455 concerning fiber-reinforced glass or glass-ceramic matrix projectile barrels 12 is hereby incorporated in its entirety in all jurisdictions which permit such incorporation by reference.

Regardless of whether comprised of a metal alloy, a metal matrix composite, refractory metal, or ceramic composite, the liner 30 may be formed using the materials and fabrication techniques described in U.S. Pat. No. 7,721,478, which is incorporated herein in its entirety, including but not limited to its disclosures concerning fiber wrapping and infiltration/pyrolysis to form the matrix and deposition of refractory metal on the interior of the thin-wall tube.

The liner 30, 30' may also incorporate one or more phase change materials that respond to heat by changing phases, thereby "absorbing" heat energy. Potentially acceptable phase change materials include materials that change from one solid to another, or from an encapsulated solid to a liquid. The liner 30 may also comprise a shape memory alloy, such as disclosed in US patent application 2012/0227302, which is hereby incorporated in its entirety in all jurisdictions which permit incorporation by reference. The liner 30 may also vary in wall thickness along the length of the tube to accommodate different design pressure requirements or mechanical attachment requirements.

As shown in FIGS. 6-8, the interior surface of the liner 30 may be coated with an inner thermal barrier 32, which comprises one of the afore-mentioned generally concentric layers of the barrel 12. The inner thermal barrier 32 may comprise a durable inorganic glass, metal refractory alloy, a chromium alloy, functionally graded material, or a ceramic such as a thermal sprayed ceramic. The glass or ceramic inner thermal barrier 32 may be reinforced with fiber. Such coatings include refractory metal coatings such as disclosed in U.S. Pat. No. 7,721,478, which is incorporated in its entirety in all jurisdictions which permit incorporation by reference.

In this manner, the inner thermal barrier 32 is disposed within the inner cylindrical surface of the liner 30 and is fabricated from a composition selected from the group consisting essentially of an inorganic glass and a metal refractory alloy and a chromium alloy and a functionally graded material and a ceramic. Within the context of these composition alternatives, the inner thermal barrier 32 may optionally include fiber reinforcement. The inner thermal barrier 32 provides both thermal resistance and mechanical durability to the bore of the barrel 12 which enable barrel 12 to reliably function as a launcher of fin-stabilized projectiles that is light and easily transported by ground troops, that can withstand continuous firings without overheating or evidence of harmful erosion, but that does not sacrifice firepower. The inner thermal barrier 32 also helps manage thermal effects and differing coefficients of thermal expansion between and among the several dissimilar layers of the barrel 12.

The inner thermal barrier 32 may be applied as a coating by electrolytic or electroless plating, sputtering, explosive cladding, coaxial energetic deposition, electromagnetically enhanced physical vapor deposition, plasma processes, thermal spraying, salt bath treatments or other techniques known in the art. The inner thermal barrier 32 may be applied in multiple layers and include layers having varying compositions and/or applied by a plurality of methods, with multiple layers addressing variations in coefficients of thermal expansion and improving durability. The thermal barrier coating may not only provide thermal resistance and mechanical durability, but may also help manage coefficient of thermal expansion differences between dissimilar materials.

The plurality of generally concentric layers of the barrel 12 may also include an outer thermal barrier 34 surrounding the outer surface of the liner 30, particularly in cases where the liner 30 is of a metal alloy or a metal matrix composite as in FIG. 6-7. That is to say, the ceramic composition liner 30' of FIG. 8 may omit the outer thermal barrier 34 due to the natural thermal performance attributes of ceramic materials. The outer thermal barrier 34 is, preferably, applied as a coating that is fabricated from a composition selected from the group consisting essentially of an inorganic glass and a metal refractory alloy and a chromium alloy and a functionally graded material and a ceramic. Like the inner thermal barrier 32, the outer thermal barrier 34 may also include fiber reinforcement.

Like the aforementioned inner thermal barrier 32, the outer thermal barrier 34 may be applied by electrolytic or electroless plating, sputtering, explosive cladding, coaxial energetic deposition, electromagnetically enhanced physical vapor deposition, plasma processes, thermal spraying, or other techniques known in the art. The outer thermal barrier 34 may be applied in multiple layers and include layers having varying compositions and/or applied by a plurality of methods, with multiple layers addressing variations in coefficients of thermal expansion and improving durability.

The plurality of generally concentric layers of the barrel 12 further includes an overwrap 36 surrounding the outer thermal barrier 34. In cases where the outer thermal barrier 34 is omitted, the overwrap 36 directly surrounds the outside surface of the liner 30. Therefore, regardless of the base composition of the liner 30 (i.e., metallic or ceramic), the liner 30 is surrounded by the overwrap 36, which is in the form of outer shell matrix composite comprising one or more continuous strand fibers set in a matrix material. The overwrap 36 may include non-cylindrical features or be discontinuous over the length of barrel 12.

Generally stated, the overwrap 36 is a layer built-up by a plurality of strategically laid structural fibers 38 embedded in a matrix 40. Overwrap 36 is a continuous fiber composite (CFC). comprised of continuous fibers 38 such as continuous polyacrylonitrile (PAN) and pitch carbon fibers, continuous glass fibers, continuous ceramic fibers, continuous metallic fibers, continuous graphite fibers, continuous mineral fibers, continuous polymer fibers, and combinations thereof; and a matrix 40 binder material such as an organic polymer, an inorganic polymer, a metal, a ceramic, allotropes of carbon, or a mineral. It may be desirable to promote adhesion or to inhibit corrosion between the liner 30 and the CFC overwrap 36 by means of a surface treatment that is applied before overwrap 36 is fabricated upon liner 30. For example, a CFC overwrap 36 is in "direct contact" with a steel liner 30 at interface 26 even if the steel liner 30's surface is electroplated, anodized, or coated with a chemical compound or mixture, such as paint, resin, hot glass, or other substance.

The fibers 38 are preferably fabricated from a composition selected from the group consisting essentially of carbon fibers and boron fibers and silicon carbide fibers. Before wrapping around the liner 30, the fibers 38 may be collected into a grouped tow. Instead of tows, the fibers 38 can be collected into fabric prepreg or unidirectional tape. In one embodiment, the individual fiber 38 strands may each have a diameter of approximately 7 μm (microns), with a tow comprising about 12,000 individual carbon fiber strands 38. Despite this distinction, to facilitate the foregoing description the terms fiber and tow may be used more or less interchangeably. Thus, continuous fiber filaments 38 or tows are wound in a back-and-forth helical pattern, or applied as braided or woven fabric or unidirectional tape, upon the liner 30 serving as an integral mandrel. The modulus of elasticity of the fibers 38 could be standard, intermediate or high. Examples of standard modulus carbon fibers 38 include Hexcel AS4 and Mitsubishi Grafil 34-700. Examples of intermediate modulus carbon fibers 38 include PAN-based Hexcel IM2A and Hyosung Tansome® H3055. Examples of high modulus carbon fibers 38 include pitch-based Mitsubishi Dialead® K1352U and Nippon Graphite Fiber Granoc® CN-60. Instead of or in combination with carbon and/or boron fibers 38, the particulates/fibers 38 might comprise one or more ceramic materials, for example continuous silicon carbide fiber such as Nicalon or Sylramic.

Figure 2:
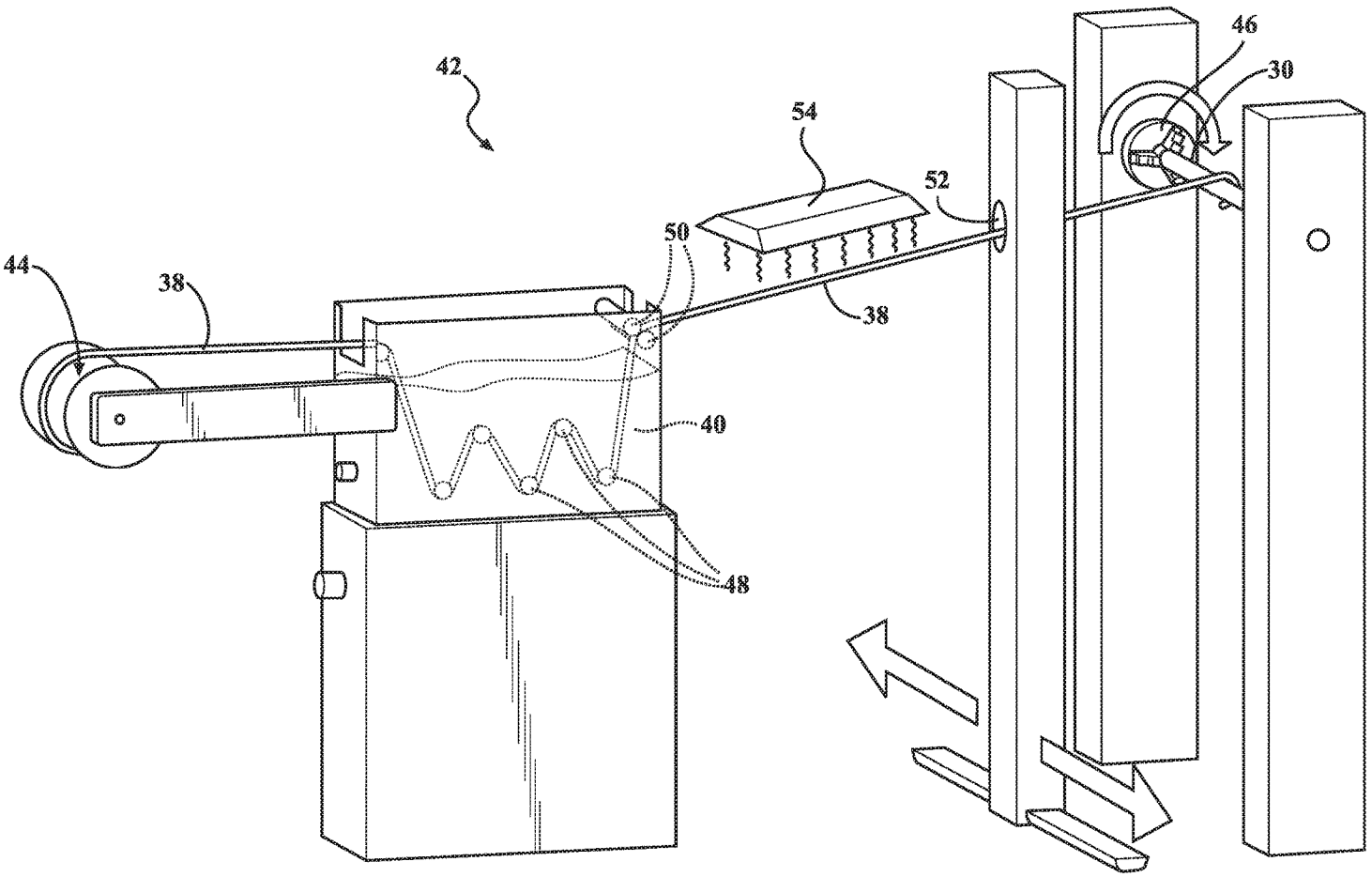
FIG. 2 is a highly simplified perspective view of an exemplary resin tow winding system.
Figure 3:
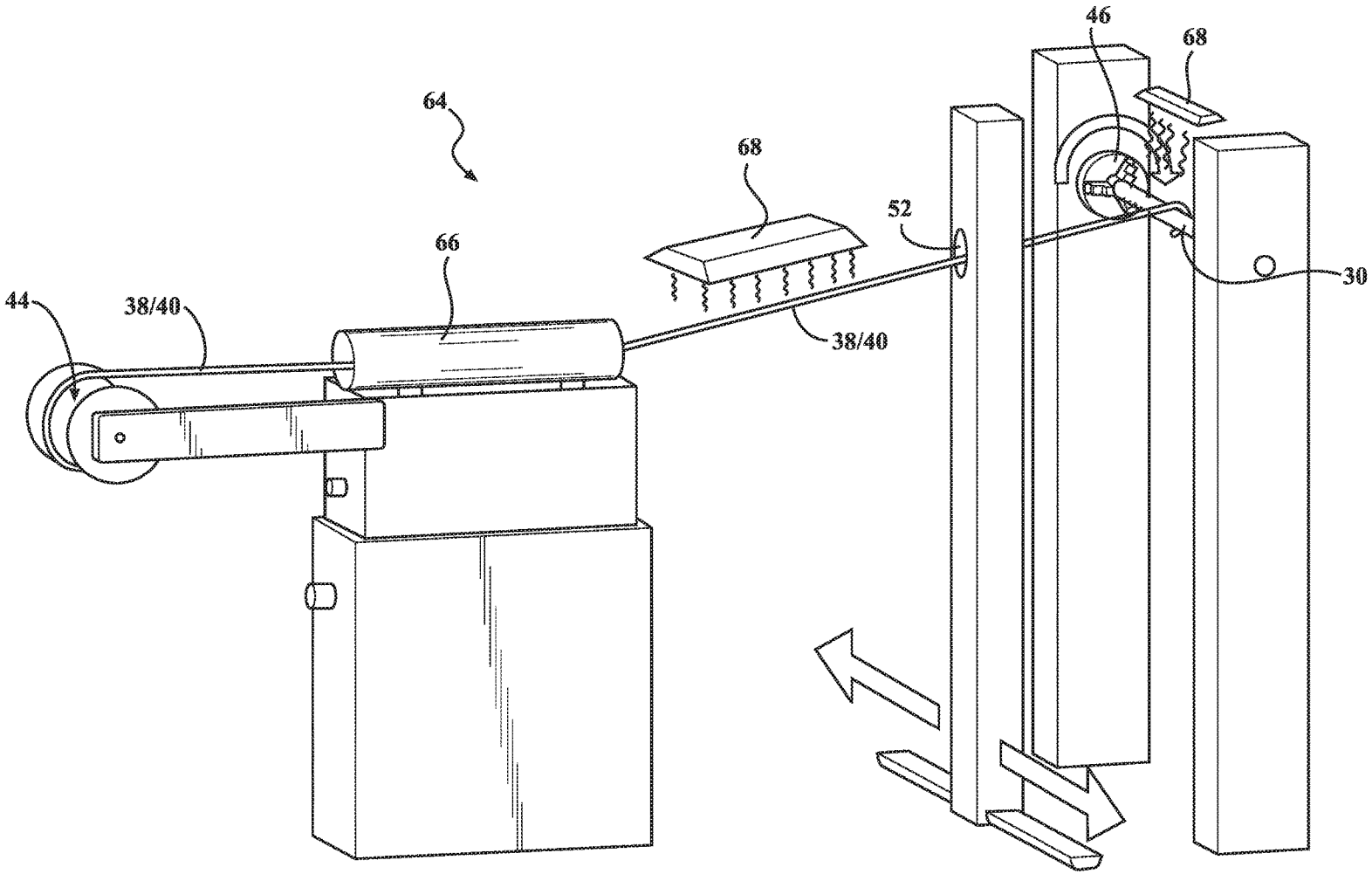
FIG. 3 is a highly simplified perspective view of an exemplary dry towpreg winding system.

The fibers 38 are preferably collected into a flat tow as suggested in the illustrations of FIGS. 2 and 3. In one embodiment, the individual carbon fiber strands are PAN precursor carbon fibers. In one embodiment, tow 38 is Hextow IM2A carbon fiber filament available from Hexcel Corporation. IM2A is an aerospace grade PAN carbon fiber having an intermediate modulus of elasticity. This PAN carbon fiber exhibits good strength and stiffness, good heat conductivity, yet its cost is affordable for commercial manufacturing purposes.

The matrix 40 fabricated from a composition selected from the group consisting essentially of a resin and a polymer and a ceramic and a glass and a metal. One purpose of the matrix 40 is to bind the fibers 38 into a monolithic overwrap layer 36. The matrix 40 may be a resin, polymer, ceramic, glass, metal, or combinations of layers of each. The matrix 40 could be a high temperature epoxy or a high temperature polymer resin such as thermoset addition cure polyimides, thermoplastic condensation cure polyimides, bismaleimides, phenolics, bismaleimides, phthalonitriles, or cyanate esters, etc. The matrix 40 could also comprise inorganic materials such as metal, polysilazane, polysilazane copolymers, polycarbosilazanes, polycarbosilazane copolymers, borazine based polymers, or polyborazaline based polymers, etc. The matrix 40 could also comprise inorganic glasses, such as aluminosilicate glass, soft glass, hard glass, or Jean glass, etc.

In the example of FIG. 8, where the liner 30 is composed of a ceramic material, it may be desirable to fabricate the overwrap 36 from similar ceramic materials, such as silicon carbide fiber 38 and, silicon carbide, silicon nitride, or SiAlON.

FIG. 2 shows a simplified tow winding system, generally shown at 42. In this highly simplified example, the continuous fiber filament 38, or tow, is supplied from tow spool 44 and the liner 30 is supported in chucks 46 for rotation about its longitudinal (i.e., bore) axis. Tow 38 is drawn from the tow spool 44 under tension by rotating liner 30, which at this stage functions as a mandrel. The rotating liner 30 tugs tow 38 through a matrix 40 bath, dipping around a series of rollers 48 which help to press or infuse matrix 40 into the fibers within the tow 38. Those skilled in the art will appreciate that there are multiple ways of applying matrix 40 to the tow 38. In another embodiment (not shown), tow 38 could be drawn across the upper surface of a semi-immersed rotating drum wetted with matrix material 40. Brisk movement of tow 38 through the matrix 40 bath and around the rollers 48 creates currents and turbulence which helps maintain resin solids and other particulates in suspension. Optionally, an agitator (not shown) may be placed in the bath to facilitate uniform mixing and viscosity. The agitator may be a mechanical paddle driven by a motor, a recirculation pump, an ultrasonic agitator, or other means for maintaining solids and particulates in suspension. After the filament is impregnated with the matrix 40, excess resin mixture may be removed from the tow 38 by means of nip rollers 50 having an appropriate gap setting, scrapers (not shown), appropriately-sized dies (not shown) and/or other means known in the art, individually or in combination.

The bath may be configured to heat matrix 40 using techniques known to those skilled in the art, such as circulating a hot fluid, such as water, through a jacket surrounding the bath, or applying heating elements to the bottom or sides of the bath, or via a heating coil immersed in matrix 40. Matrix 40 comprising a thermoset polyimide resin may be heated up to about 200° F., the precise temperature being dependent on the characteristics of the resin and the volatility of the solvent used, with somewhat lower temperatures preferred. Higher temperatures make matrix 40 less viscous, enabling better impregnation and more uniform winding, but accelerate solvent loss and may accelerate premature cure reactions in a polyimide resin (e.g., imidization) thereby reducing "pot life" of the resin.

Matrix 40 preferably comprises a solvent. Many solvents may be utilized to make the polyimide resin less viscous, including alcohols, aprotic solvents, and mixtures thereof. The PMR polyimide resin will typically include an alcohol co-reactant that acts as a solvent. A solvent having a lower boiling point (i.e., higher volatility) is generally more desirable because it can be more easily flashed off the the infused tow 38 with heating units such as a heat unit 48. Methanol and ethanol are preferred solvents. The inventors have determined that heating P2SI 635LM PMR polyimide matrix 40 to about 40° C. to 60° C. in the bath, and adding methanol solvent to reduce the viscosity of matrix 40 to about 1000 cP, yields good resin impregnation and uniform filament winding operations. It is possible to achieve lower viscosity and better handling characteristics by adding more solvent. However, too much solvent will result in insufficient resin solids in matrix 40 to adequately impregnate a carbon fiber tow 38 with resin. Using too high of a temperature to reduce the resin viscosity results in undesirable side-reactions that reduce the cured thermal and mechanical properties of the polyimide polymer matrix.

A solvent such as methanol in matrix 40 has a lower boiling point than the polyimide resin. It is preferable to flash off much or most of the solvent on the infused tow 38 before it is covered by subsequent windings of tow. As discussed above, heating means may include one or more radiant heaters 48, tube heaters, convective heaters, conductive heat originating from a heated mandrel, or other heating means. In one embodiment, a tube heater surrounds the infused tow 38 and blows air heated to about 300° F. along the tow, directed back towards the bath, and a radiant heater directs heat upon rotating liner 30.

Tow 38 thus infused with the matrix 40 exits the bath and is drawn through a programmable/controllable filament guide orifice 52. Filament guide orifice 52 includes a mechanism for laterally translating generally parallel to the bore axis, thereby guiding the infused tow 38 back and forth along rotating liner 30, so that the infused tow 38 is applied to liner 30 in a helical winding pattern. Filament guide orifice 52 itself may also rotate or translate relative to filament guide orifice 52.

The tow winding system 42 may be controlled by a computer processor, so that rotation speed of the liner 30, lateral movement of the filament guide orifice 52, tension applied to tow 38, and other aspects may be programmed by a user to produce desired patterns and sequences of winding angles, number of layers, and depths of the layers. Such systems are available from, for example, McLean Anderson, 300 Ross Avenue, Schofield, Wis. 54476.

Optionally, one or more heating elements 54 may flash off first stage volatiles present in matrix 40 after the infused tow 38 exits the bath. The heating elements 54 cause volatilization of some or even most of any solvent that is present on matrix 40 infused tow 38. The heating elements 54 may be placed anywhere on the path of infused tow 38, including heating the mandrel liner 30 itself. The heating elements 54 may be radiant heaters, tube furnace/heaters, convection heaters, or other means of heating infused tow 38, including various types of heating elements in combination.

After the excess matrix 40 is mechanically removed and optionally subjected to heating, the infused tow 38 is wound around the liner 30 in a desired helical pattern and to a desired diameter. If the liner 30 rotates at a constant rate, faster lateral movement of the filament guide orifice 52 will result in a helical winding pattern of the infused tow 38 characterized by smaller winding angles relative to the bore axis. At a brisk lateral speed, the helical winding angle of resin infused tow 38 will be small, nearly longitudinal relative to the bore axis. Conversely, slower lateral movement of filament guide orifice 52 will result in larger helical winding angles relative to the bore axis. At very slow lateral speeds, winding angles of the infused tow 38 may be nearly circumferential hoops, i.e., almost 90 degrees. For purposes of the claims and this specification, such nearly circumferential hoops are nevertheless "helical." It will be appreciated that the term "helical" means substantially helical, even though portions of the liner 30 may not be strictly cylindrical.

It should be understood that the completed overwrap 36 could comprise more than one type of fiber 38. One might simultaneously wind a plurality of tows having different characteristics, e.g., two carbon fiber 38 tow strands having complementary characteristics such as PAN and pitch, or that the type of fiber 38 in tow could be changed as the overwrap 36 is being wound, such as using PAN fiber for hoops then switching to pitch fiber tows for some or all of the longitudinal-oriented windings, without altering the intended meaning of the present invention. Similarly, it is intended that one might use a plurality of tows 38 within the overwrap 36 without departing from the scope of the claimed invention, for example utilizing a different fiber 38 type depending on region, or combining a plurality of tows.

To increase the burst strength of the barrel 12, it may be advantageous to wind tows 38 circumferentially about liner 30 in helical hoops, e.g. ±85° (plus or minus about 5° relative to the longitudinal axis of the barrel 12). For axial strength and stiffness, to minimize barrel 12 from flexing due to shockwaves arising from discharge of a projectile for example, it is preferable to have more longitudinal helical wraps, e.g. ±25° (again plus or minus about 5° measured relative to the longitudinal axis of barrel 12). To promote maximum axial stiffness with the fewest tows, it is preferable to locate the longitudinal helical wraps at or near the outer region of overwrap 36. The surface of overwrap 36 can be made more durable to wear and tear, however, if the outer region of overwrap 36 is wrapped at a less acute angle, e.g. 45°.

Figure 4:
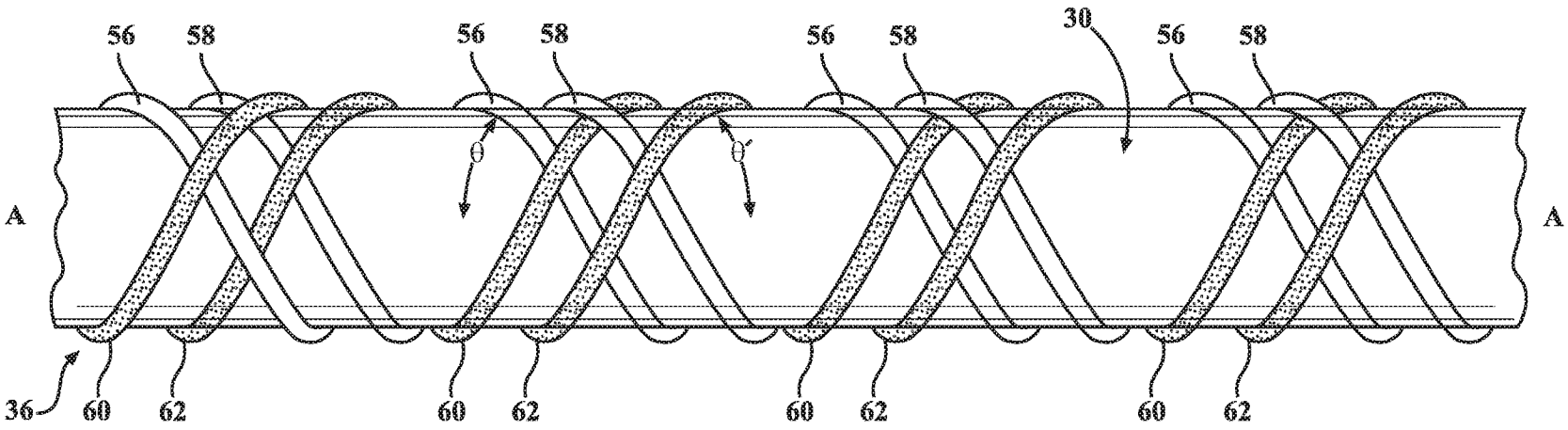
FIG. 4 is a fragmentary view of a liner in the process of being wrapped at a substantially constant wrapping angle according to one embodiment of the present invention.

Unless the context dictates otherwise, all references herein to "winding angle" or "wrap angle" includes the positive and negative measured fiber angles relative to the longitudinal axis A of the barrel 12. This is illustrated in FIG. 4, which shows a section of liner 30 in the initial stage of being wrapped with tow 38. (In practice, tow 38 typically has a wide, flat profile. Its profile is "fattened" in FIG. 4 to better illustrate tow placement.) Tow 38 is helically wrapped around liner 30 as filament guide 52 translates laterally relative to rotating liner 30. The first lateral pass (left to right) winds a first tow segment 56. When filament guide 52 completes its translation and reaches the end of liner 30, it reverses and helically winds the tow 38 in the opposite direction, laying down second tow segment 58. The next pass winds third tow segment 60, and the next pass winds fourth tow segment 62. The winding angle for all four segments in FIG. 4 is the same, albeit the angles alternate between positive and negative with each pass, measured relative to the bore axis. And therefore, the angle θ shown in FIG. 4 with respect to first tow segment 56 is the "same wrapping angle" as θ' shown with respect to fourth tow segment 62. In other words, the wrapping angle shown in FIG. 4 is constant, even though the tow 38 is being laid down in a leftward or rightward direction with respect to the ends of the liner 30.

Figure 5:
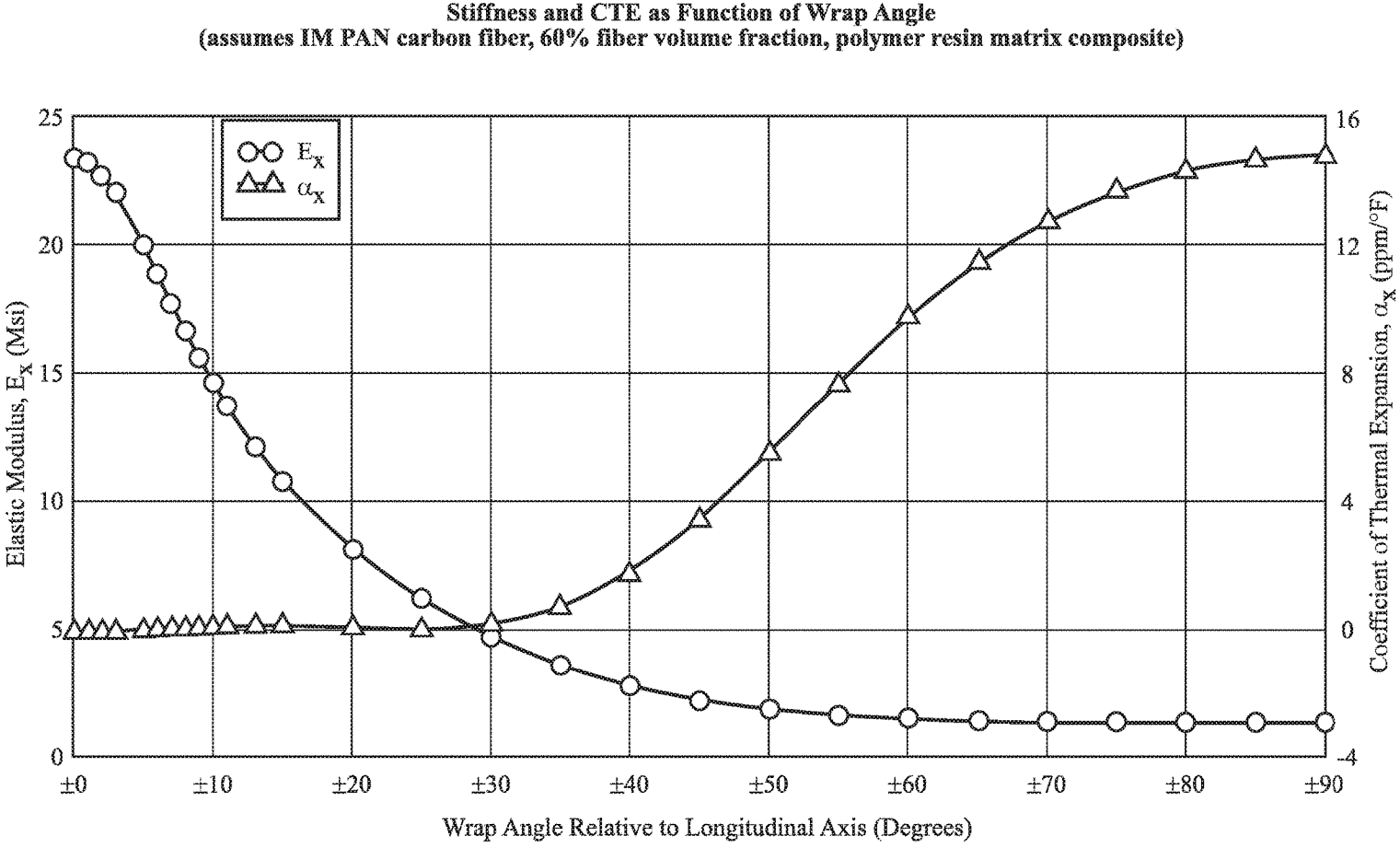
FIG. 5 is a chart showing the relationship between fiber wrap angle, angle effect on axial stiffness, and angle effect on the axial coefficient of thermal expansion (CTE)

As noted, axial stiffness varies with the wrap angle of tow 38. FIG. 5 shows stiffness numbers calculated under classical laminate theory assuming an intermediate modulus PAN carbon fiber at 60% fiber volume fraction in a polymer resin matrix 40 composite. The first data on the chart shows the effect of wrap angle on the stiffness of the outer shell in the axial direction, measured as millions of pounds per square inch (Msi). At zero degrees relative to the long axis of the barrel 12 (i.e., parallel to its bore axis) the elastic modulus Ex is nearly 24 Msi, which approaches type AISI 416 stainless steel (UNS 541600) which has Ex of 29 Msi. As the winding angle relative to the barrel 12 axis increases, stiffness drops sharply. At a winding angle of ±45°, Ex falls to about 2.4 Msi. For near-perpendicular "hoop" windings, their contribution to axial stiffness is small, falling to under 2 Msi.

The overwrap layer 36 is preferably engineered to provide the required axial strength and stiffness, and sufficient burst strength for the barrel 12 while approximately matching the average coefficient of axial thermal expansion for the thin-walled liner 30. FIG. 5 also shows the effect of winding angle on the linear coefficient of thermal expansion (CTE). Lower winding angles (i.e., more axially aligned) have much lower CTE α. Near-perpendicular wrap angles (hoops) have relatively high longitudinal CTE, about 15 ppm/° F. The CTE of liner 30 may vary considerably depending on composition. For example, a ceramic or ceramic composite liner 30' may have a CTE that is considerably less than steel. AISI 4140 steel has a CTE of approximately 6.8 ppm/° F. As mentioned previously, AISI 416 stainless steel has a CTE of approximately 5.55 ppm/° F. As indicated in FIG. 5, if the entire overwrap 36 could be wrapped at a constant angle of about 48°, the average effective longitudinal CTEs of overwrap 36 and a type 416 stainless steel liner 30 would approximately match, theoretically solving many of the problems arising from mismatched CTEs. However, it is not practical to wrap the entire overwrap 36 at that angle, at least partly because a uniform 48° wrap would not provide sufficient axial stiffness or burst strength without excessive windings.

The average effective longitudinal CTE of the overwrap 36 will therefore vary depending not only on wrap angle, but on a variety of other factors including matrix 40 composition (e.g., whether resin versus ceramic or metal, type of resin, etc.), presence of matrix 40 additives such as thermally conductive heat dissipation additives, fiber 38 type, tow tension during wrapping, regional wrap angle sequence, and regional wrap angle thicknesses. All of these factors must be considered when attempting to match the average effective longitudinal CTE of the CFC outer shell to the CTE of the steel liner 30. It is possible to design and fabricate an overwrap layer 36 having a desired average effective longitudinal CTE fabricated from materials other than unidirectional carbon fiber continuous tows, including for example textile composite pre-preg carbon fiber, and carbon fiber braided sleeves. Non-carbon materials may also be used, such as ceramic, glass, mineral, polymer or metallic fibers, or mixtures thereof.

More specifically, it is possible to match the average effective axial CTE of an overwrap 36 to the CTE a liner 30 by using a plurality of wrapping regions, while also providing excellent axial, radial, and torsional strength and stiffness, yet keeping bulk and weight at a minimum. Using known CTE data and wrapping techniques familiar to those skilled in the art of fiber laminates, e.g. the relationships illustrated in FIG. 5, it is possible to engineer an overwrap 36 having good structural properties and a desired average effective CTE by wrapping a plurality of regions, each region having substantially the same winding angle and each having a radial thickness relative to the radial thickness of the CFC.

Thus, the overwrap 36 will preferably have an average axial coefficient of thermal expansion that is approximately equal to the average axial coefficient of thermal expansion of the liner 30. However, there may be some offset due to engineering and other constraints. Preferably the inner 32 and outer 34 thermal barriers are designed to exhibit respective coefficients of thermal expansion that are inclusively between the average CTE's of the liner 30 and the overwrap 36. That is to say, the average coefficient of thermal expansion of the inner thermal barrier 32 is preferably within a range established between the average coefficient of thermal expansion of the liner 30 and the average coefficient of thermal expansion of the overwrap 36. And similarly, the average coefficient of thermal expansion of the outer thermal barrier 34 is within a range established between the average coefficient of thermal expansion of the liner 30 and the average coefficient of thermal expansion of the overwrap 36.

The overwrap 36 may be structured in successive regions, with each region having substantially the same winding angle. The radial thickness of each region as a percentage of the overwrap layer 36 radius can vary. Known classical laminate theory may be used to engineer the overwrap 36 having a wide range of average effective longitudinal CTEs using a plurality of layered wrapping regions. The average effective CTE of the composite overwrap 36 is adjusted by varying the wrap angles of the plurality of regions, the regions' radial thicknesses, and the number and sequence of regions. The CTE may also be varied by changing the composition of matrix 40, the type of fiber 30, and the tension at which fiber tow 38 is wrapped on liner 30. For example, one embodiment that approximately matches the CTE of type 416 stainless steel inner liner 30 with the CTE of CFC overwrap 36 comprises intermediate modulus PAN precursor carbon fibers and thermoset epoxy resin. This embodiment not only virtually eliminates thermal stresses due to CTE mismatch that can lead to deformation and displacement, but also provides superior performance, durability, with relatively low bulk and weight, at a commercially viable price for materials. "Approximately matches" for purposes of this specification and the claims means that the inner liner's longitudinal CTE is within 1 ppm/° F. of the average effective longitudinal CTE associated with the CFC outer shell.

In addition to matching the average effective longitudinal CTE of overwrap 36 with liner 30, a superior barrel 12 design also exhibits high axial strength and stiffness, low interlaminar shear stress during operation, and high hoop strength. Low angle plies (e.g., ±25°) provide more axial stiffness than higher angles. Moreover, the further away a given mass of longitudinal plies is located from the liner 30, the greater its contribution to axial stiffness. However, placing longitudinal low-angle plies on the outside of barrel 12 compromises durability, because they are more likely to delaminate or suffer interlaminar failure, such as when rubbed against a rough surface. Placing higher angle plies in the outer regions enhances durability. Preferably, the overwrap 36 will have an axial stiffness of at least 5.5 Msi and a modulus in the radial plane (the radial plane containing angle E on FIG. 7) of at least 10 Msi. Torsional strength and stiffness become more critical factors in medium and large caliber firearm barrels 12 where the mass and diameter of the projectile become significant relative to the barrel 12 outer diameter, imparting significant torsional force on the barrel 12.

Rather than drawing the tow 38 through wet matrix bath, a dry towpreg (i.e., fiber 38 that has been previously coated and/or impregnated with a matrix 40 having a high glass transition temperature) may be wrapped on the rotating liner 30 then dry-cured with heat and/or pressure. Imidized towpreg 38/40 may be fabricated by first processing a polyimide resin to a partially-cured state in the following manner. A polymerizable monomeric polyimide resin (PMR) is heated to about 300-500° F. for between about thirty minutes to four hours to imidize the resin so that oligomers form, having reactive endcaps. Preferably, the heat is withdrawn and the resin is cooled before the functional endcapping agents on the oligomers commence significant reacting and cross linking. The imidized polyimide resin, being now in solid form, may then be ground into a fine powder. This powder may then be electrostatically coated on a fiber 38 or split tape, then optionally thermally fused to the fiber 38 or tape before re-spooling.

FIG. 3 shows a towpreg winding system, generally shown at 64, similar to the tow winding system 42 in FIG. 2. A fiber spool 44 carries a supply of partially cured towpreg 38/40 prepared as described immediately above. The towpreg 38/40 is heated prior to and/or during application to rotating liner 30 in order to soften the partially cured polyimide resin previously incorporated into towpreg 38/40 thus allowing it to flow and facilitate consolidation. FIG. 3 shows several variants of possible heating techniques, including a tube heater 66 and radiant heaters 68. Other heat sources may include infrared heaters, hot air jets, and laser heating. Both the towpreg 38/40 and the rotating liner 30 may be heated above the melting point of the polymer to achieve melt/melt contact between the towpreg 38/40 and the liner 30. The rotating liner 30 may be heated, for example, by a radiant heater 68 and/or by a cartridge heater (not shown) placed within the bore. Any of the foregoing heater types, alone or in combination, may be used to heat the towpreg 38/40 and/or liner 30 so that the towpreg 38/40 achieves good melt contact with the liner 30. The softened and heated towpreg 38/40 is wound around liner 30 in a fashion similar to that described above.

In another embodiment, matrix 40 (or the dry partially cured towpreg 38/40) also comprises particles of a thermally conductive additive. The additive particulate may theoretically comprise any solid having a higher thermal conductivity than the resin in a polymer matrix composite (PMC), such as metal, ceramic, or chopped pitch carbon fiber. Graphene platelets, ground graphite foam, or carbon nanotubes also have good thermal conductivity. Due to its combination of relatively low density, higher thermal conductivity, cost, and other superior attributes within the cured PMC, metal is a preferred thermal conductive additive material, and more preferably aluminum.

Adding significant quantities of thermal conducting additive could adversely increase the viscosity of the matrix 40. For example, graphene platelets exhibit excellent thermal conductivity but tend to make resin mixture unacceptably viscous. Graphene platelets might have an area (X-Y dimension) between 1 and 50 micrometers (μm) but a thickness of only about 50-100 nanometers (nm), yielding an aspect ratio approaching 1000:1. Particles having such high aspect ratios exacerbate the viscosity issues afflicting polyimide resins discussed above. Rather than focusing on additive materials having the best thermal conductivity, an alternate approach is to employ a material that allows maximization of additive volume versus additive surface area. This approach suggests the additive particles should be approximately spherical.

In one embodiment, the additive particles are metal and have generally spherical shape. The metal spheres comprise approximately 0.2% to 50% by weight of matrix 40 (about 0.1% to 25% by volume). In another embodiment, the additive particles are themselves comprised of two or more sizes in order to more efficiently increase the thermal conductivity of the composite with minimal effect on processing characteristics. Having at least two sizes of thermally conductive particles in matrix 40 improves particle packing within the interstitial spaces with less impact on the resin viscosity and consequently improves heat transfer characteristics while keeping viscosity manageable.

In one embodiment, fiber strands 38 are approximately 7 μm in diameter and the thermal conducting additive comprises three sizes of approximately spherical aluminum particles, the smallest particles being about 0.1-1 μm in diameter, the medium particles being about 1-3 μm in diameter, and the large particles being about 3-4 μm in diameter. These particle sizes can vary depending, for example, on the size of the fibers 38. For example, the largest particles could measure 10 μm. Most of the additive consists of small particles and medium particles; a significantly smaller fraction is large particles. By formulating and distributing the thermal conductive additive in such fashion, many of the particles will be in close proximity or even touching each other, and preferably in close proximity and/or touching adjacent fiber tows 38, with the larger particles tending to occupy the larger interstitial spaces and the smaller particles occupying the smaller voids, which voids were formerly occupied by the solvent or volatile fraction of matrix 40 that was volatilized in the curing process. The thermal conducting additive particles have higher thermal conductivity than resin, thereby making the PMC more thermally conductive. On average, the plurality of sizes of thermally conductive additive spheres occupy a higher volume fraction of the interstitial space otherwise present in the PMC, leading to higher thermal conductivity of overwrap 36.

After winding wet resin tow 38 or heated towpreg 38/40, the partially formed composite barrel 12 is removed from the chucks 46 and subjected to heat and/or pressure to completely cure the matrix composition 40. For wet resin systems, depending on the amount of volatiles present prior to commencing the cure process, a complete cure might require removing about 15% of the mass of the freshly wound structure. It is generally better to remove the volatiles earlier in the curing process to minimize formation of voids in the matrix.

Regardless of whether the tow is wound or laid on liner 30 wet or dry, it is more difficult to cure structures incorporating polyimide resins than common epoxy-based resins. In wet resin applications particularly, it is difficult to remove volatiles from the fiber 38 resin matrix 40 without creating voids. When a polyimide resin is used with flat or large-radius panels, volatile transport is easier because volatiles can escape to the open edges of the surface, and/or more readily migrate between fabric layers. In filament winding applications, however, these gasses can be trapped between the continual windings.

Voids in the overwrap 36 have the undesirable effects of reducing strength, stiffness, and thermal conductivity. Satisfactory results are even more difficult to achieve when curing an item produced by filament winding, in contrast to curing flat impregnated fabric sheets. The impervious liner 30 forces volatiles to migrate radially outward through a plurality of densely wound layers (with a much smaller portion of volatiles migrating to the breech 14 and muzzle 16 of the barrel 12). The curing problem may be compounded still further when thermally conductive additives are present in matrix 40.

A cured overwrap 36 according to one embodiment is produced by first providing PAN carbon fibers 38 and a matrix 40 comprising P2SI 635LM polyimide resin and about 40% concentration by weight of generally spherical aluminum particles between 1 and 5 microns. Such a matrix 40 has a glass transition temperature of about 635° F. after cure. The wet fiber tows 38 are passed through a tube heater as described above then wound around a liner 30 using the wet-resin system depicted in FIG. 2 to generate a plurality of winding layers at a plurality of winding angles. The freshly wound overwrap layer 36 is then placed in an oven or autoclave and cured in a series of stages.

In a first stage, the temperature in the autoclave is gradually raised, over about 5 to 10 hours, to about 350° F. To assist in volatile transport out of the overwrap 36, vacuum may be applied to liner 30 during this stage. In a second stage, the oven or autoclave temperature is increased to about 500-536° F. for between 2 and 8 hours to imidize the PMR polyimide resin mixture solution to form oligomers having reactive endcaps. At this stage, all volatiles are essentially removed from the overwrap layer 36 and the functional endcapping agents on the oligomers may start reacting and cross linking. During this second stage of the cure, pressure of between 10 and 400 psi, preferably about 200 psi, is applied to facilitate consolidation. In a third stage, the temperature within the oven or autoclave is raised even further to about 600-700° F., preferably for at least four hours, to accomplish a final cure, i.e., substantially completing cross-linking of the imidized polyimides by reacting the endcapping agents and stabilizing the carbon-fiber/resin mixture matrix. The total curing time within the oven or autoclave is preferably 14-24 hours. The autoclave may remain pressurized during the second and third stages.

Following cooling, the cured overwrap 36 with embedded liner 30 may optionally be placed on a lathe and ground down to desired finish diameter with one or more abrasive tools such as diamond-coated grinding and polishing wheels.

Returning again to FIGS. 6-8, the plurality of generally concentric layers of the barrel 12 may further include an outer shell 70 surrounding the overwrap 36. The outer shell 70 is comprised of continuous fibers embedded in a high temperature polymer matrix. This outermost layer of the composite barrel system 12 is engineered to provide superior mechanical and environmental durability. The fibers used for the outer shell 70, as well as its polymer matrix composition, may be selected from the foregoing examples.

The foregoing invention has been described in accordance with the relevant legal standards, thus the description is exemplary rather than limiting in nature. Variations and modifications to the disclosed embodiment may become apparent to those skilled in the art and fall within the scope of the invention. Furthermore, particular features of one embodiment can replace corresponding features in another embodiment or can supplement other embodiments unless otherwise indicated by the drawings or this specification.

What is claimed is:

1. A muzzle-loading mortar assembly for launching a fin-stabilized projectile, said assembly comprising:

a barrel having a generally tubular construction centered around a longitudinal axis, said barrel having a breech end and an opposite muzzle end, said barrel having a composite construction composed of a plurality of generally concentric layers, said plurality of generally concentric layers including a rigid supporting liner having an inner cylindrical surface and an outer surface, aid plurality of generally concentric layers further including an overwrap surrounding said outer surface of said liner and further including an outer thermal barrier disposed between said liner and said overwrap, said outer thermal barrier fabricated from a composition selected from the group consisting essentially of an inorganic glass and a metal refractory alloy and a chromium alloy and a functionally graded material and a ceramic, said liner fabricated from a composition selected from the group consisting essentially of a metal alloy and a metal refractory and a ceramic and a metal matrix composite and a ceramic matrix composite, said liner having an average axial coefficient of thermal expansion, said overwrap comprised of continuous fibers embedded in a matrix, said matrix fabricated from a composition selected from the group consisting essentially of a resin and a polymer and a ceramic and a glass and a metal, said overwrap having an average axial coefficient of thermal expansion approximately matching said average axial coefficient of thermal expansion of said liner, wherein said outer thermal barrier has an average coefficient of thermal expansion that is within a range established between said average axial coefficient of thermal expansion of said liner and said average axial coefficient of thermal expansion of said overwrap.

2. A muzzle-loading mortar assembly for launching a fin-stabilized projectile, said assembly comprising:

a barrel having a generally tubular construction centered around a longitudinal axis, said barrel having a breech end and an opposite muzzle end, said barrel having a composite construction composed of a plurality of generally concentric layers, said plurality of generally concentric layers including a rigid supporting liner, said liner having an inner cylindrical surface and an outer surface, wherein said plurality of generally concentric layers comprise an inner thermal barrier disposed within said inner cylindrical surface of said liner, said inner thermal barrier fabricated from a composition selected from the group consisting essentially of an inorganic glass and a metal refractory alloy and a chromium alloy and a functionally graded material and a ceramic, said liner fabricated from a composition selected from the group consisting essentially of a metal alloy and a metal refractory and a ceramic and a metal matrix composite and a ceramic matrix composite, said liner having an average axial coefficient of thermal expansion, said plurality of generally concentric layers including an overwrap surrounding said outer surface of said liner, said overwrap comprised of continuous fibers embedded in a matrix, said matrix fabricated from a composition selected from the group consisting essentially of a resin and a polymer and a ceramic and a glass and a metal, said overwrap having an average axial coefficient of thermal expansion approximately matching said average axial coefficient of thermal expansion of said liner, wherein said inner thermal barrier has an average coefficient of thermal expansion that is within a range established between said average axial coefficient of thermal expansion of said liner and said average axial coefficient of thermal expansion of said overwrap.

3. A muzzle-loading mortar assembly for launching a fin-stabilized projectile, said assembly comprising:

a barrel having a generally tubular construction centered around a longitudinal axis, said barrel having a breech end and an opposite muzzle end, said barrel having a composite construction composed of a plurality of generally concentric layers, said plurality of generally concentric layers including a rigid supporting liner, said liner fabricated from a composition selected from the group consisting essentially of a metal alloy and a metal refractory and a ceramic and a metal matrix composite and a ceramic matrix composite, said liner having an inner cylindrical surface and an outer surface, said liner having an average axial coefficient of thermal expansion, said plurality of generally concentric layers including an overwrap surrounding said outer surface of said liner, said overwrap comprised of continuous fibers embedded in a matrix, wherein said continuous fibers of said overwrap are fabricated from a composition selected from the group consisting essentially of carbon fibers and boron fibers and silicon carbide fibers, wherein said continuous fibers are laid-up around said liner in a plurality of layers and at a plurality of winding angles relative to said longitudinal axis, wherein at least one layer of said plurality of layers has a dissimilar radial thickness relative to at least one other layer of said plurality of layers, said matrix fabricated from a composition selected from the group consisting essentially of a resin and a polymer and a ceramic and a glass and a metal, said overwrap having an average axial coefficient of thermal expansion approximately matching said average axial coefficient of thermal expansion of said liner, and wherein at least one layer of said plurality of layers comprises a dissimilar fiber composition relative to at least one other layer of said plurality of layers.

4. A muzzle-loading mortar assembly for launching a fin-stabilized projectile, said assembly comprising:

a barrel having a generally tubular construction centered around a longitudinal axis, said barrel having a breech end and an opposite muzzle end, said barrel having a composite construction composed of a plurality of generally concentric layers, said plurality of generally concentric layers including a rigid supporting liner, said liner fabricated from a composition selected from the group consisting essentially of a metal alloy and a metal refractory and a ceramic and a metal matrix composite and a ceramic matrix composite, said liner having an inner cylindrical surface and an outer surface, said liner having an average axial coefficient of thermal expansion, said plurality of generally concentric layers including an overwrap surrounding said outer surface of said liner, said overwrap comprised of continuous fibers embedded in a matrix, wherein said continuous fibers of said overwrap are fabricated from a composition selected from the group consisting essentially of carbon fibers and boron fibers and silicon carbide fibers, wherein said continuous fibers are laid-up around said liner in a plurality of layers and at a plurality of winding angles relative to said longitudinal axis, said matrix fabricated from a composition selected from the group consisting essentially of a resin and a polymer and a ceramic and a glass and a metal, said overwrap having an average axial coefficient of thermal expansion approximately matching said average axial coefficient of thermal expansion of said liner, wherein at least one layer of said plurality of layers comprises a dissimilar fiber wrap angle relative to at least one other layer of said plurality of layers.

5. A muzzle-loading mortar assembly for launching a fin-stabilized projectile, said assembly comprising:

a barrel having a generally tubular construction centered around a longitudinal axis, said barrel having a breech end and an opposite muzzle end, said barrel having a composite construction composed of a plurality of generally concentric layers, said plurality of generally concentric layers including a rigid supporting liner, said liner fabricated from a composition selected from the group consisting essentially of a metal alloy and a metal refractory and a ceramic and a metal matrix composite and a ceramic matrix composite, said liner having an inner cylindrical surface and an outer surface, said liner having an average axial coefficient of thermal expansion, said plurality of generally concentric layers including an overwrap surrounding said outer surface of said liner, said overwrap comprised of continuous fibers embedded in a matrix, wherein said continuous fibers of said overwrap are fabricated from a composition selected from the group consisting essentially of carbon fibers and boron fibers and silicon carbide fibers, wherein said continuous fibers are laid-up around said liner in a plurality of layers and at a plurality of winding angles relative to said longitudinal axis, said matrix fabricated from a composition selected from the group consisting essentially of a resin and a polymer and a ceramic and a glass and a metal, said overwrap having an average axial coefficient of thermal expansion approximately matching said average axial coefficient of thermal expansion of said liner, wherein at least one layer of said plurality of layers comprises a dissimilar fiber tension relative to at least one other layer of said plurality of layers.

6. A muzzle-loading mortar assembly for launching a fin-stabilized projectile, said assembly comprising:

a barrel having a generally tubular construction centered around a longitudinal axis, said barrel having a breech end and an opposite muzzle end, said barrel having a composite construction composed of a plurality of generally concentric layers, said plurality of generally concentric layers including a rigid supporting liner, said liner fabricated from a composition selected from the group consisting essentially of a metal alloy and a metal refractory and a ceramic and a metal matrix composite and a ceramic matrix composite, said liner having an inner cylindrical surface and an outer surface, said liner having an average axial coefficient of thermal expansion, said plurality of generally concentric layers including an overwrap surrounding said outer surface of said liner, said overwrap comprised of continuous fibers embedded in a matrix, said matrix fabricated from a composition selected from the group consisting essentially of a resin and a polymer and a ceramic and a glass and a metal, said overwrap having an average axial coefficient of thermal expansion approximately matching said average axial coefficient of thermal expansion of said liner, wherein said plurality of generally concentric layers includes an outer shell surrounding said overwrap, said outer shell comprised of continuous fibers embedded in a thermoset polymerizable monomer reactant (PMR) polyimide resin matrix.

7. A composite barrel assembly for a gun that launches projectiles driven by the action of an explosive force, said assembly comprising:

a barrel having a generally tubular construction centered around a longitudinal axis, said barrel having a breech end and an opposite muzzle end, said barrel having a composite construction composed of a plurality of generally concentric layers, said plurality of generally concentric layers including a rigid supporting liner, said liner fabricated from a composition selected from the group consisting essentially of a metal alloy and a metal refractory and a ceramic and a metal matrix composite and a ceramic matrix composite, said liner having an inner cylindrical surface and an outer surface, said plurality of generally concentric layers including an overwrap surrounding said outer surface of said liner, said overwrap comprised of continuous fibers embedded in a matrix, said matrix fabricated from a composition selected from the group consisting essentially of a resin and a polymer and a ceramic and a glass and a metal, said plurality of generally concentric layers including an inner thermal barrier disposed within said inner cylindrical surface of said liner, said inner thermal barrier fabricated from a composition selected from the group consisting essentially of an inorganic glass and a metal refractory alloy and a chromium alloy and a functionally graded material and a ceramic, said plurality of generally concentric layers including an outer shell surrounding said overwrap, said outer shell comprised of continuous fibers embedded in a thermoset PMR polyimide resin matrix, wherein said liner has an average axial coefficient of thermal expansion, said overwrap having an average axial coefficient of thermal expansion approximately matching said average axial coefficient of thermal expansion of said liner, wherein said inner thermal barrier is fabricated from a composition selected from the group consisting essentially of an inorganic glass and a metal refractory alloy and a chromium alloy and a functionally graded material and a ceramic, said inner thermal barrier having an average coefficient of thermal expansion that is within a range established between said average axial coefficient of thermal expansion of said liner and said average axial coefficient of thermal expansion of said overwrap.

8. A muzzle-loading mortar assembly for launching a fin-stabilized projectile, said assembly comprising:

a barrel having a generally tubular construction centered around a longitudinal axis, said barrel having a breech end and an opposite muzzle end, a blast attenuator affixed to said muzzle end, said breech end being closed, said barrel having a composite construction composed of a plurality of generally concentric layers, said plurality of generally concentric layers including a rigid supporting liner, said liner fabricated from a composition selected from the group consisting essentially of a metal alloy and a metal refractory and a ceramic and a metal matrix composite and a ceramic matrix composite, said liner having an average axial coefficient of thermal expansion, said liner having an inner cylindrical surface and an outer surface, said plurality of generally concentric layers including an inner thermal barrier disposed within said inner cylindrical surface of said liner, said inner thermal barrier having an average coefficient of thermal expansion, said inner thermal barrier fabricated from a composition selected from the group consisting essentially of an inorganic glass and a metal refractory alloy and a chromium alloy and a functionally graded material and a ceramic, said inner thermal barrier including fiber reinforcement, said plurality of generally concentric layers including an outer thermal barrier surrounding said liner, said outer thermal barrier fabricated from a composition selected from the group consisting essentially of an inorganic glass and a metal refractory alloy and a chromium alloy and a functionally graded material and a ceramic, said outer thermal barrier having an average coefficient of thermal expansion, said outer thermal barrier including fiber reinforcement, said plurality of generally concentric layers including an overwrap surrounding said outer thermal barrier, said overwrap comprised of continuous fibers embedded in a matrix, said overwrap having an average axial coefficient of thermal expansion approximately matching said average coefficient of thermal expansion of said liner, said continuous fibers fabricated from a composition selected from the group consisting essentially of carbon fibers and boron fibers and silicon carbide fibers, said continuous fibers being wound around said liner in a plurality of layers and at a plurality of winding angles relative to said longitudinal axis, at least one layer of said plurality of layers having a dissimilar radial thickness relative to at least one other layer of said plurality of layers, at least one layer of said plurality of layers comprising a dissimilar fiber composition relative to at least one other layer of said plurality of layers, at least one layer of said plurality of layers comprising a dissimilar fiber wrap angle relative to at least one other layer of said plurality of layers, at least one layer of said plurality of layers comprising a dissimilar fiber tension relative to at least one other layer of said plurality of layers, said matrix fabricated from a composition selected from the group consisting essentially of a resin and a polymer and a ceramic and a glass and a metal, said plurality of generally concentric layers including an outer shell surrounding said overwrap, said outer shell comprised of continuous fibers embedded in a thermoset PMR polyimide resin matrix, wherein said average coefficient of thermal expansion of said inner thermal barrier is within a range established between said average axial coefficient of thermal expansion of said liner and said average axial coefficient of thermal expansion of said overwrap, wherein said average coefficient of thermal expansion of said outer thermal barrier is within a range established between said average axial coefficient of thermal expansion of said liner and said average axial coefficient of thermal expansion of said overwrap, a baseplate, a coupling interconnecting said baseplate and said breech end of said barrel for articulating movement therebetween, said baseplate having a plurality of cleats, a mounting arm connected to said barrel, said mounting arm including a length adjustment device, said mounting arm including an angular adjustment device, and a sighting unit affixed relative to said barrel for optically surveying a downrange target.

* * * * *